United States Patent [19]

Theurer

[11] 4,043,271

[45] Aug. 23, 1977

[54] MOBILE TRACK TAMPING MACHINE

[75] Inventor: Josef Theurer, Vienna, Austria

[73] Assignee: Franz Plasser Bahnbaumaschinen-Industrie-Gesellschaft m.b.H., Vienna, Austria

[21] Appl. No.: 650,022

[22] Filed: Jan. 19, 1976

[30] Foreign Application Priority Data

Feb. 27, 1975 Austria ..... 1536/75

[51] Int. Cl.[2] ..... E01B 27/16

[52] U.S. Cl. ..... 104/12

[58] Field of Search ..... 104/12, 10, 13, 7 R, 104/7 A, 7 B, 8

[56] References Cited

U.S. PATENT DOCUMENTS

| | | | |
|---|---|---|---|
| 2,969,749 | 1/1961 | Plasser et al. | 104/12 |
| 3,735,708 | 5/1973 | Plasser et al. | 104/12 |
| 3,965,822 | 6/1976 | Stewart | 104/12 |

FOREIGN PATENT DOCUMENTS

| | | | |
|---|---|---|---|
| 2,228,959 | 4/1973 | Germany | 104/12 |
| 2,119,757 | 12/1971 | Germany | 104/12 |

*Primary Examiner*—Robert J. Spar
*Assistant Examiner*—Carl Rowold
*Attorney, Agent, or Firm*—Kurt Kelman

[57] ABSTRACT

A mobile track tamping machine has a vertically movable tamping tool assembly with pairs of tamping tools for tamping ballast under the track ties and an additional tamping tool reciprocable in the direction of the tie ends to box in the tamped ballast, as well as a vibratory surface tamper for tamping the ballast adjacent the tie ends. The additional tamping tool and the surface tamper are associated with each other in closely adjacent relationship next to the tie ends, the vibratory force of the surface tamper reaching at least to, preferably over the entire, reciprocatory path of the additional tamping tool.

9 Claims, 3 Drawing Figures

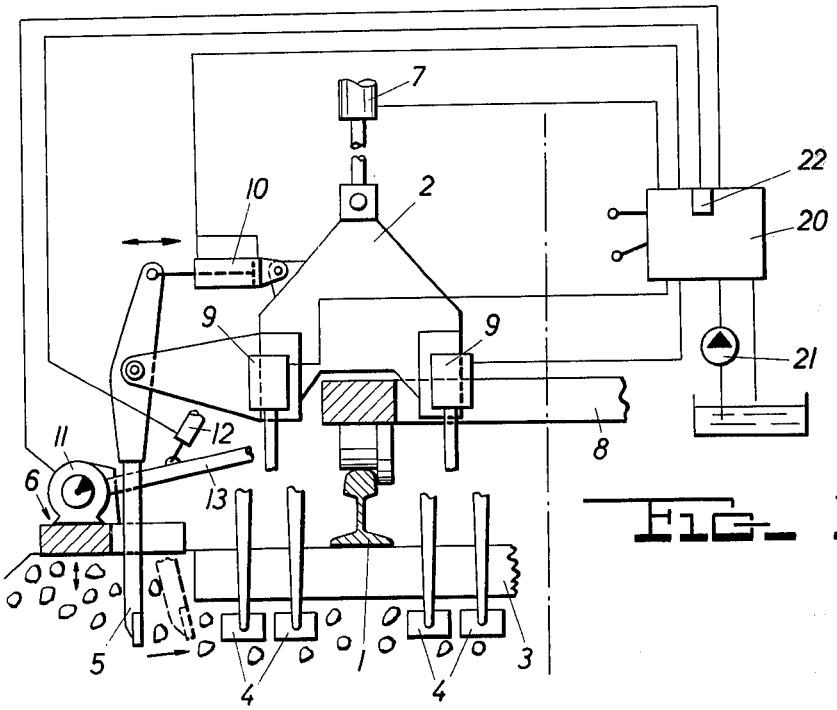
FIG. 1
FIG. 2
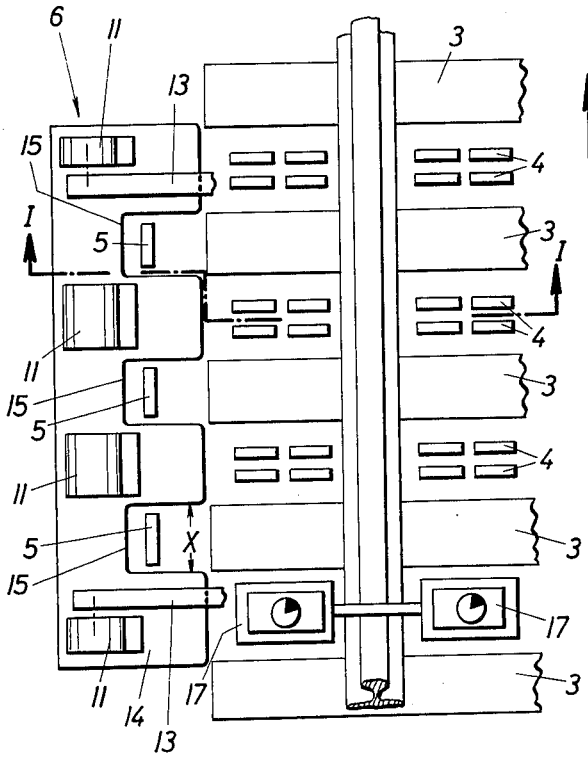
FIG. 3
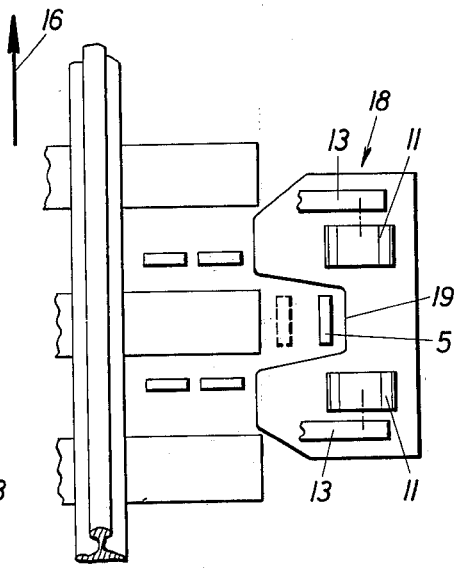

MOBILE TRACK TAMPING MACHINE

The present invention relates to improvements in a mobile track tamping machine for compacting ballast supporting a track consisting of rails mounted on ties having two elongated edges extending transversely of the rails and two ends extending in the direction of the rails, the elongated tie edges of adjacent ones of the ties defining cribs therebetween. More particularly, this invention relates to a machine of this type which comprises a frame, a tamping tool assembly vertically movably mounted on the frame for tamping a respective one of the ties, and a vibratory surface tamper for tamping the ballast adjacent a tie end. The tamping tool assembly includes a pair of opposed vibratory tamping tools arranged for immersion in the cribs adjacent one tie and for reciprocation in the direction of the rails, with the one tie positioned between the opposed tools, and an additional tamping tool arranged for immersion in the ballast adjacent the end of the one tie and for reciprocation in a direction transversely of the rails.

Track tamping must take into consideration a number of factors. Its quality depends, for instance, on the type of ballast in the bed, the length of the track ties, particularly that portion of the ties extending from the rails to the ends thereof, the strength of that tie portion, the maximal loads and speeds to which the track is subjected, as well as other parameters.

In my U.S. Pat. No. 3,910,195, dated Oct. 7, 1975, I have disclosed a track tamper which assures a ballast support of excellent quality for the critical portion of the track where the rails and ties intersect. This type of tamper has given excellent results in track surfacing but the arrangement of the vibratory drives for the additional tamping tools reciprocating in the direction of tie elongation has caused some construction difficulties because these drives must be mountd within the profile of the track.

In German Offenlegungsschrift (Published Application) No. 2,228,959, published Apr. 12, 1973, it has been proposed to provide a vibratory surface tamper for tamping the ballast adjacent the tie end, particularly for compacting the ballast strip extending between the tie ends and the side slopes of the ballast bed. This serves particularly for filling in any holes in the ballast caused by the lateral alignment of the track.

It is the primary object of this invention further to improve the flow of the ballast being tamped between the reciprocatory vibratory tamping tools moving the ballast inwardly under the ties from the elongated edges as well as the ends thereof whereby the resistance of the ties against lateral movement on the tamped ballast bed as well as the rigidity of the ballast bed to resist vertical loads is increased even under high-speed train traffic.

This and other objects are accomplished in accordance with the invention by associating the additional non-vibratory tamping tool and the vibratory surface tamper with each other in closely adjacent relationship next to the tie end, the vibratory tamping force of the surface tamper reaching at least to the reciprocatory path of the additional non-vibratory tamping tool, preferably reaching into the path or even encompassing the entire path.

With this very close association of the reciprocatory tamping tool and the surface tamper, the ballast in the region of the tie ends as well as the ballast bed slope is subjected to uniform and strong vibrations to produce a unitary ballast flow during the tamping operation. This produces an equally compacted ballast under the tie end portions on which the track rests as well as in the ballast bed portion laterally adjacent the tie ends so that the ballast provides a support of substantially equal strength and compaction against vertical and lateral forces to which the track may be subjected during use. The substantially uniform resistance against lateral movement of the track provided by the tamped ballast laterally adjacent the tie ends causes any tensions in welded lengths of rails, due to high ambient temperatures, for instance, to be distributed uniformly over the rails, thus preventing warping of the track rails.

Furthermore, the association of the surface tamper and the reciprocatory tamping tool simplifies the construction because special vibratory drives for the reciprocatory tamping tool may be omitted since this tool may be vibrated with the surface tamper with which it is associated. This enables the tamping tool assembly to be built more compactly so that the machine may also be used in tunnels and like narrow rights of way.

The above and other objects, advantages and features of the present invention will become more apparent from the following detailed description of now preferred embodiments thereof, taken in conjunction with the accompanying drawing wherein.

FIG. 1 is a schematic end view, partly in section along line I—I of FIG. 2, of a tamping apparatus associated with one rail, for simultaneously tamping a plurality of ties;

FIG. 2 is a schematic top view showing the essential tamping means of the apparatus of FIG. 1 in their functional cooperation; and FIG. 3 shows a modified arrangement of the tamping apparatus for tamping a single tie.

Referring now to the drawing, the illustration of the tamping apparatus of this invention is highly schematic because mobile track tampers, with their reciprocatory vibrating tamping tools and hydraulic reciprocating and vibrating drives for the tools, are very well known in the art and require neither detailed showing or description. Mobile track tamping machines comprise, as schematically illustrated, a frame 8 which is supported on wheels for mobility on track rails 1, the rails being fastened to ties 3 which have two elongated edges extending transversely of the rails and two ends extending in the direction of the rails, the elongated tie edges of adjacent ties 3 defining cribs therebetween. Tamping tool assembly 2 is vertically movably mounted on frame 8 for tamping a single tie (as in the embodiment of FIG. 3) or a plurality, i.e. two, ties (as in the embodiment of FIG. 2). Hydraulic drive 7 is connected to the tamping tool assembly to move the assembly vertically on the frame in a manner well known per se.

The tamping tool assembly includes at least one pair of opposed vibratory tamping tools 4, 4 arranged for immersion in the cribs adjacent one tie and for reciprocation in the direction of the rails, with a respective tie positioned between the opposed tools, as in FIG. 3, or two ties positioned between two such coordinated pairs of opposed tamping tools, as in FIG. 2, a double-tie tamper of this type being disclosed, for instance, in U.S. Pat. No. 3,357,366, dated Dec. 12, 1967. Hydraulic drive 9 is arranged to reciprocate the tamping tools 4 of the opposed pairs of tools and to vibrate the tools during the tamping operation. An additional non-vibratory tamping tool 5 or a plurality of such tools, depending on whether it is a single-tie or double-tie tamper, is arranged for immersion in the ballast adjacent an end of tie or ties 3 and for reciprocation in a direction transversely of the rails, hydraulic drive 10 being arranged to reciprocate tamping tool 5. Operation of hydraulic drive 7 will lower the tamping tool assembly 2 to immerse its tamping tools 4 and 5 in the ballast, and to lift them out of the ballast after the tamping operation has been completed. All of this structure and operation is entirely conventional.

A vibratory surface tamper 6 for tamping the ballast adjacent the tie end or ends is mounted for operation in the region of the ballast bed between the tie ends and the slope of the bed, vibrators 11 being mounted on base or tamping plate 14 of the surface tamper to impart vibrations thereto. The surface tamper is mounted on machine frame 8 by means of a conventional support linkage system (not shown), including guide rod 13 connected to hydraulic drive 12 to enable the surface tamper to be lifted and lowered in a vertical plane extending transversely of rails 1.

As will be appreciated from a view of FIGS. 2 and 3, the additional tamping tool(s) 5 and vibratory surface tamper 6 or 18 are associated with each other in such closely adjacent relationship next to the tie end(s) that the vibratory tamping force of the surface tamper reaches at least to, and preferably into, the reciprocatory path of the additional tamping tool(s), this force encompassing the entire reciprocatory path of these tools in the illustrated embodiments.

In the embodiment of FIG. 2, elongated vibratory surface tamper 6 extends in the direction of rails 1 over a plurality, i.e. four, cribs and additional tamping tools 5, and base plate 14 of the surface tamper has an edge facing the track and defining a plurality, i.e. three, guide recesses 15. The illustrated recesses are U-shaped to provide a path for the reciprocation of tamping tools 5. This arrangement enables the base plate of the surface tamper to be brought very close to the ends of the ties with its edge facing the track so as to provide the desired closely adjacent association of tamping tools 5 and surface tamper 6, which permits the vibratory force of the surface tamper to overlap with the vibratory tamping action of the reciprocatory tamping tools.

Also, the illustrated embodiment shows a most useful dimensioning of the associated tampers, the tamping plates of reciprocatory tamping tools 5 having a width slightly less than that of ties 3 while recesses 15 have a width slightly in excess of that of the tamping plates, which permits immersion and reciprocation of tamping tools 5 in the ballast without interference by the surface tamper while, at the same time, providing guidance and close association of the tamping tools 5 with surface tamper 6.

Uniform compaction of the ballast on both sides of rails 1 will be assured by mounting on the machine further vibratory surface tampers 17 for compacting the ballast in the cribs, these further surface tampers being arranged for operation in a crib behind the cribs wherein opposed tamping tools 4 operate, as seen in the operation direction of the machine, indicated by arrow 16.

The embodiment of FIG. 3 differs only in that it is designed for tamping one tie at a time, i.e. only a single pair of opposing reciprocatory tamping tools and a single additional reciprocatory tamping tool are mounted on the tamping tool assembly. Vibratory surface tamper 18 is accordingly shorter than surface tamper 6 and has a single recess 19 for receiving a guiding tamping tool 5 during reciprocation transversely of the track. This surface tamper extends over two cribs and recess 19 has inwardly slopping guide faces enabling the inner edge of the base plate of the surface tamper to be arranged even more closely to the track, reaching slightly into the cribs, as shown in FIG. 3.

The operation of the mobile track tamping machine will partly be obvious from the above description of its structure and will be further elucidated hereinafter.

A hydraulic fluid circuit connects the output of pump 21 with hydraulic drives 7, 9, 10, 11 and 12, the input of the pump receiving hydraulic fluid from a hydraulic fluid tank. Control 20 including time delay element 22 is arranged in the hydraulic fluid circuit to control the flow of hydraulic fluid to drive 12. The track tamping machine advances intermittently in the direction of arrow 16 during the tamping operation, stopping for the tamping of each tie (FIG. 3) or group of ties (FIG. 2) in a manner well known in track surfacing operations. As is also known, a track sensor may be arranged to send a control signal to control 20 when the machine stops or a manually operated lever may be actuated to set the control to deliver hydraulic fluid to drives 7 and 12. Operation of these drives will lower tamping tool assembly 2 to immerse tamping tools 4 and 5 in the ballast, while surface tamper 6 is lowered into engagement of its base or tamping plate 14 with the ballast. At the same time, control 20 will also permit delivery of hydraulic fluid to drives 9, 10 and 11, thereby vibrating the tamping tools and the surface tamper, and reciprocating tamping tools 4 and 5.

After the tamping operation has been completed by the combined vibration and reciprocation of the associated tampers (see the position of tamping tool 5 in broken lines in FIGS. 1 and 3), control 20 is operated again to deliver hydraulic fluid to the opposite cylinder chamber of drive 7 to raise the tamping tool assembly until tamping tools 4 and 5 are removed from the ballast. Hydraulic drive 12 is connected to time delay element 22 so that hydraulic fluid is delivered to the opposite cylinder chamber of drive 12 after it has been delivered to drive 7, thus causing the surface tamper 6 to remain in tamping position and to tamp the ballast after the reciprocatory tamping tools have ceased their tamping. In this manner, any portions of the ballast which have been loosened by the withdrawal of tamping tools 4 and 5 from the tamped ballast bed will be compacted by the continued operation of the surface tamper, thus assuring a homogeneous compaction of the entire tamped ballast area, this uniformity of the ballast density being further enhanced by crib surface tampers 17.

Obviously, the hydraulic drives could be replaced by other suitable mechanisms for reciprocating the tamping tools and for vibrating the tamping tools and surface tampers, such mechanisms includes spindle drives and the like. Also, the surface tampers may take various forms, one or several adjacent base or tamping plates being used, as well as a single vibrator for each surface tamper instead of the illustrated plurality of vibrators.

I claim:

1. In a mobile track tamping machine for compacting ballast supporting a track consisting of rails mounted on ties having two elongated edges extending transversely of the rails and two ends extending in the direction of the rails, the elongated tie edges of adjacent ones of the ties defining cribs therebetween, which comprises a frame; a tamping tool assembly vertically movably mounted on the frame for tamping a respective one of the ties, the tamping tool assembly including a pair of opposed vibratory tamping tools arranged for immersion in the cribs adjacent one tie and for reciprocation in the direction of the rails, with the one tie positioned between the opposed tools, and an additional non-vibratory tamping tool arranged for immersion in the ballast adjacent an end of the one tie and for reciprocation in a direction transversely of the rails; and a vibratory surface tamper for tamping the ballast adjacent the tie end: the improvement of associating the additional non-vibratory tamping tool and the vibratory surface tamper with each other in closely adjacent relationship next to the tie end, the vibratory tamping force of the surface tamper reaching at least to the reciprocatory path of the additional non-vibratory tamping tool.

2. In the mobile track tamping machine of claim 1, the additional non-vibratory tamping tool and the vibratory surface tamper being arranged so that the vibratory tamping force of the surface tamper reaches into the reciprocatory path of the additional non-vibratory tamping tool.

3. In the mobile track tamping machine of claim 1, the additional non-vibratory tamping tool and the vibratory surface tamper being arranged so that the vibratory tamping force of the surface tamper encompasses the entire reciprocatory path of the additional non-vibratory tamping tool.

4. In the mobile track tamping machine of claim 1, the vibratory surface tamper extending in the direction of the rails over a plurality of cribs, the elongated surface tamper having an edge facing the track and defining a guide recess receiving each reciprocatory additional non-vibratory tamping tool.

5. In the mobile track tamping machine of claim 4, each additional non-vibratory tamping tool including tamping plate of a width sightly less than that of each ties, and the recess having a width slightly in excess of the width of the tamping plate.

6. In the mobile track tamping machine of claim 5, the width of each recess being substantially the same as the width of the ties.

7. In the mobile track tamping machine of claim 4, each recess being U-shaped.

8. In the mobile track tamping machine of claim 1, the vibratory surface tamper being pivotal in a vertical plane extending transversely of the rails, hydraulic drives for pivoting the surface tamper and for operating the tamping tools, and further surface tampers for compacting the ballast in the cribs, the further surface tampers being arranged for operating on a crib adjacently behind the cribs wherein the opposed tamping tools operate, as seen in the operating direction of the machine, and the vibratory surface tamper extending to said crib.

9. In the mobile track tamping machine of claim 1, a first hydraulic drive for vertically moving the tamping tool assembly, a second hydraulic drive for pivoting the vibratory surface tamper in a vertical plane extending transversely of the rails, whereby the tamping tool assembly and the surface tamper may be lowered and raised, and a control including a time delay element for operating the hydraulic drives to raise the tamping tools assembly and the surface tamper, the second hydraulic drive being connected to the time delay element.

* * * * *